United States Patent [19]

Staub et al.

[11] 4,000,482

[45] Dec. 28, 1976

[54] TRANSFORMER WITH IMPROVED NATURAL CIRCULATION FOR COOLING DISC COILS

[75] Inventors: Fred W. Staub; Ramachandran Muralidharan, both of Schenectady, N.Y.

[73] Assignee: General Electric Company, Schenectady, N.Y.

[22] Filed: Dec. 31, 1975

[21] Appl. No.: 645,562

Related U.S. Application Data

[63] Continuation of Ser. No. 500,260, Aug. 26, 1974, abandoned.

[52] U.S. Cl. ..... 336/60

[51] Int. Cl.[2] ..... H01F 27/10

[58] Field of Search ..... 336/55, 57, 58, 60, 336/185; 310/65

[56] References Cited

UNITED STATES PATENTS

| | | | |
|---|---|---|---|
| 717,006 | 12/1902 | Johannesen | 336/60 X |
| 873,166 | 12/1907 | Nichols | 336/60 X |
| 1,652,911 | 12/1927 | Slater | 336/60 X |
| 2,339,625 | 1/1944 | DeBlieux | 336/60 X |
| 2,388,566 | 11/1945 | Paluev | 336/60 |
| 2,831,173 | 4/1958 | Whitman | 336/60 X |
| 2,912,658 | 11/1959 | Paluev | 336/60 X |
| 3,548,354 | 12/1970 | Schwab | 336/60 X |

FOREIGN PATENTS OR APPLICATIONS

| | | | |
|---|---|---|---|
| 493,437 | 4/1919 | France | 336/60 |
| 46-15364 | 5/1971 | Japan | 336/60 |
| 167,916 | 8/1921 | United Kingdom | 336/60 |
| 887,383 | 1/1962 | United Kingdom | 336/58 |

*Primary Examiner*—Thomas J. Kozma
*Attorney, Agent, or Firm*—Paul R. Webb, II; Joseph T. Cohen; Jerome C. Squillaro

[57] ABSTRACT

A liquid-cooled electrical transformer with a disc or flat coil transformer winding conventionally has vertical cooling ducts at both coil edges for upward flow of coolant by natural circulation. Higher winding ratings are obtained by mounting staggered partial flow barrier inserts in the vertical cooling ducts to force a small radial flow of coolant between the individual coils for improved heat transfer without excessively reducing the coolant flow rate.

5 Claims, 3 Drawing Figures

TRANSFORMER WITH IMPROVED NATURAL CIRCULATION FOR COOLING DISC COILS

This is a continuation of application Ser. No. 500,260, filed Aug. 26, 1974, and now abandoned.

BACKGROUND OF THE INVENTION

This invention relates to the cooling of electrical transformers, and more particularly to transformers with disc or flat coil windings having provision for improved natural circulation of the liquid coolant.

Liquid-cooled medium and power transformers of the type having disc coil windings mounted about a magnetic core structure are commonly either force-cooled by pumping the insulating oil or other coolant through the windings, or are cooled by natural circulation of the coolant upwardly through the windings by the free convection mechanism. In these liquid-cooled transformers, a pair of concentric cylindrical duct walls are mounted within and surrounding the disc winding, thereby defining inner and outer axial ducts for coolant flow in the vertical direction at each side of the coils. In force-cooled equipment, prior practice has been to use complete barriers in the vertical cooling ducts at alternate vertically spaced locations inside and outside the disc coils to thereby circulate the pumped coolant in a zig-zag path through the winding. Since there is some coolant flow through the horizontal ducts between adjacent coils, this arrangement has good heat transfer characteristics.

As a variation in forced-oil cooled transformers, it is disclosed in Japanese Utility Model Application No. SHO 43-2020 published under Utility Model No. SHO-46-15364 that the alternate complete barrier rings or inserts placed at intervals of several coils to establish a zig-zag flow path can be supplemented by graduated partial barrier rings or inserts in each section to provide more uniform velocity of flow between the disc coils. The horizontal length of the partial barrier ring increases with vertical height in each section to thereby achieve increased resistance to flow in the several horizontal ducts and result in an equal balance of flow resistances. When used in conjunction with the complete barriers, however, the effect of adding graduated partial barriers alternately in the vertical cooling ducts is to increase the total flow resistance. The Japanese patent configurations are illustrated and discussed in application Ser. No. 527,549 filed Mar. 27, 1974, now U.S. Pat. No. 3,902,146 by R. Muralidharan, entitled "Transformer with Improved Forced Liquid Cooled Disc Winding".

Transformer disc coils cooled by natural circulation only must be considerably derated in order to avoid excessive winding temperature rise. Ordinarily, the vertical cooling ducts are provided without flow barriers to minimize flow pressure drop and thus maximize vertical coolant flow past the winding. This results in poor heat transfer due to the absence of or excessively limited coolant flow horizontally between the individual disc coils. The use of alternate complete flow barriers in the vertical cooling ducts, such as is employed in force cooled systems, is not desirable in natural circulation arrangements since full barriers result in too low a coolant flow and consequent excessive temperature raise.

SUMMARY OF THE INVENTION

In accordance with the invention, in a natural circulation cooled electrical transformer with vertically mounted disc or flat coil windings as previously described, it has been found that partial flow barrier inserts or rings, mounted in staggered relation in the inner and outer vertical cooling ducts at either side of the winding, are effective to force a minor amount of coolant flow horizontally between the individual disc or flat coils without excessively reducing the total coolant flow. Because of the improvement in heat transfer that is realized, higher winding ratings are made possible, and this is achieved inexpensively in a manner compatible with a wide variety of present transformer configurations. Preferably, the partial flow barrier inserts are attached to the inner and outer peripheries of selected individual coils, in alternating fashion, at a uniform vertical spacing of every several coils. The resulting coolant flow pattern can be referred to as a modified zig-zag type flow path. Suitably the amount of staggered partial blockage is such that the partial flow barrier inserts have a horizontal width equal to about half to three-quarters the width of the vertical cooling ducts. If desired, the partial flow barrier inserts can be omitted from predetermined portions of the transformer winding, such as the cooler lower part of the winding.

DESCRIPTION OF THE PREFERRED EMBODIMENT

Figure 1:
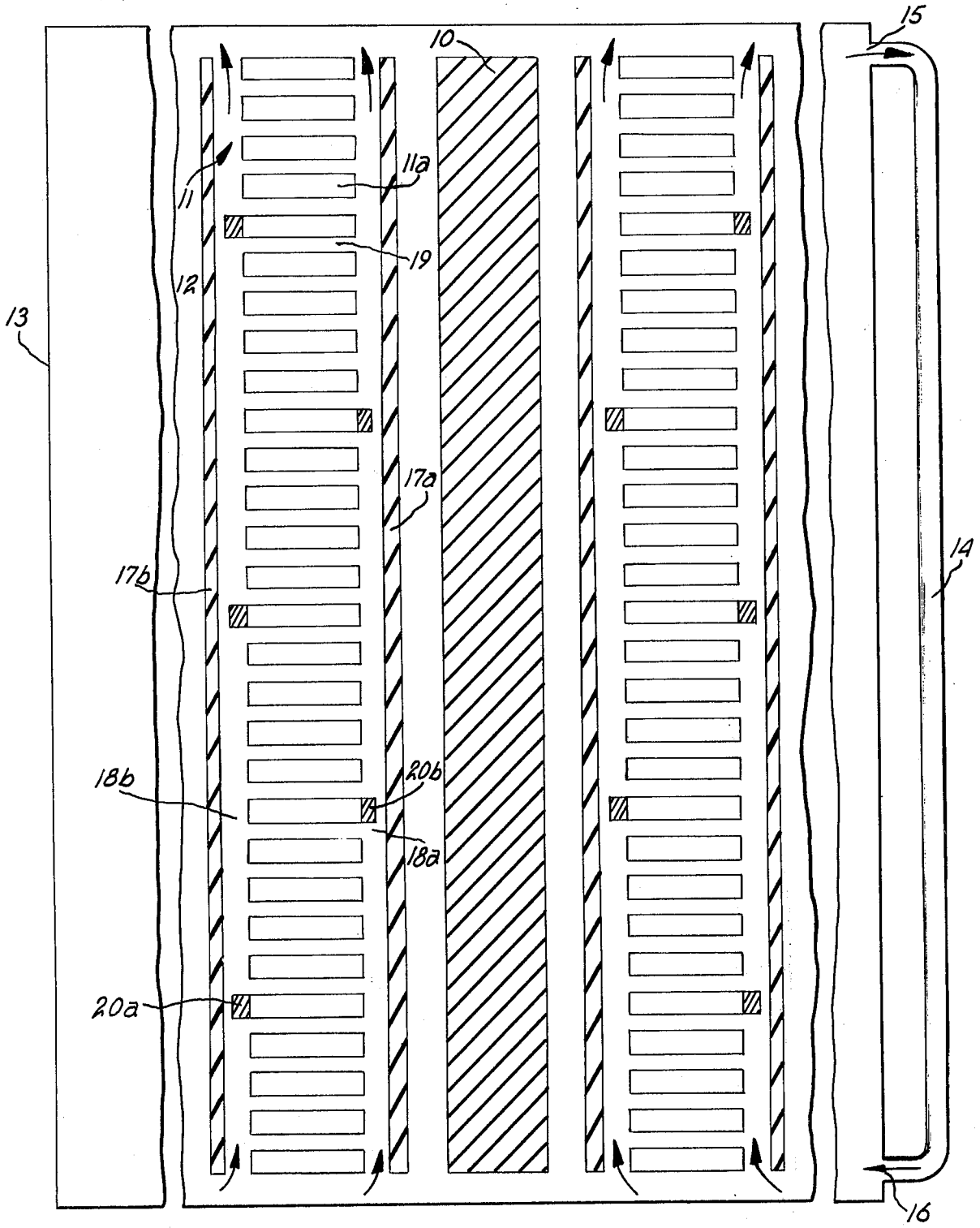
FIG. 1 is a diagrammatic vertical cross section, with parts omitted, through a transformer showing a single magnetic core and disc coil winding assembly immersed in a liquid coolant in a tank with provision for external cooling of the naturally circulated coolant.

In FIG. 1 is shown in diagrammatic form a magnetic core and disc coil winding sub-assembly or assembly such as is used in self-cooled medium and power electrical transformers. The sub-assembly is comprised by a vertically oriented magnetic core element 10 and associated surrounding disc coil winding indicated generally at 11, and is immersed in a suitable liquid coolant 12 such as insulating oil or pyranol contained within a transformer tank 13. Although described primarily with regard to a disc coil configuration, the invention is applicable generally to flat coils of any shape. A number of cooling and recirculation lines 14 for the liquid coolant are mounted exterior to the tank adjacent to one side wall or completely around its periphery, each making connection between an outlet manifold 15 near the top of the tank and an inlet manifold 16 near the bottom of the tank. Heated coolant entering the exterior recirculation lines 14 is cooled by radiation cooling to the atmosphere or by forced air cooling using fans, and naturally circulates downwardly to re-enter the tank near the bottom. Self-cooled transformers with disc coil or flat coil windings are made in a variety of single-phase and multi-phase configurations with different arrangements of primary and secondary windings. In a three-phase power transformer, for example, there are three such magnetic core winding legs all interconnected in a suitable magnetic core structure and immersed together with their windings in a large rectangular tank. Most commonly, several concentric disc coil windings are mounted surrounding the vertical magnetic core in each leg and connected respectively as the primary, secondary, and perhaps tertiary windings. In some transformers, the primary and secondary windings are alternated in a single disc coil winding.

Figure 2:
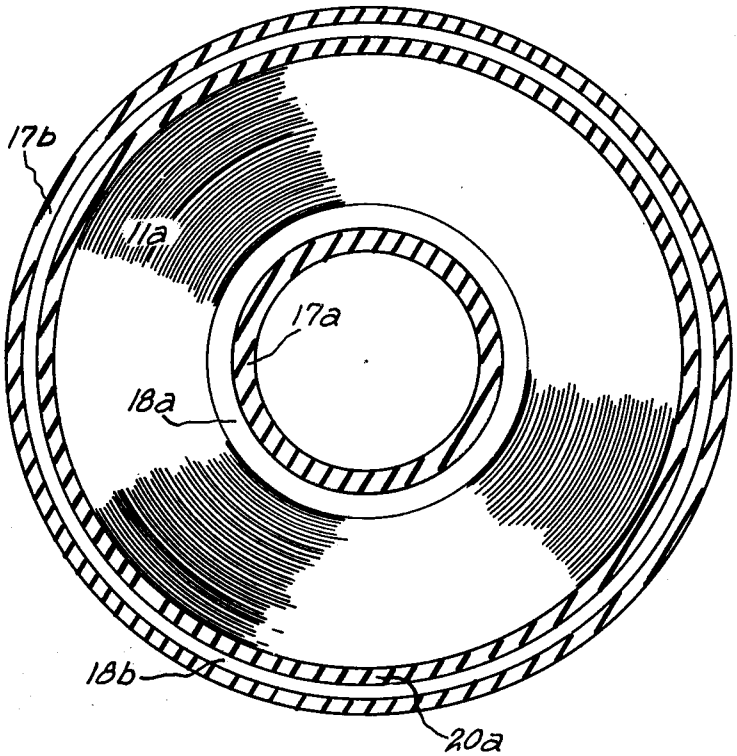
FIG. 2 is a horizontal cross section through the disc coil winding and duct walls of FIG. 1 illustrating an outer partial flow barrier insert.

Disc coil winding 11 is comprised by a large number of individual disc coils or flat coils 11*a* assembled vertically with an equal spacing between individual coils. Each disc coil 11*a* (see also FIG. 2) is annular in shape and tightly wound so as to be continuous. Within the coil itself, no ducts are provided for a passage of liquid coolant. The individual disc coils 11*a* are stacked vertically one upon the other using spacer members (not shown) made of pressboard or other suitable insulating material. The electrical connections of the individual coils to form a winding are also not shown. As is conventional, a pair of concentric vertical cylinders 17*a* and 17*b* are mounted inside of and outside of the disc winding 11, respectively equally spaced from the inner periphery and the outer periphery of the individual disc coils. These concentric cylinders provide parallel cooling duct walls to constrain the circulation of liquid coolant 12 upwardly through the disc winding by the free convection mechanism. The duct walls 17*a* and 17*b* are also made of pressboard or other suitable insulating material. The annular space thus defined between the inner periphery of the disc winding 11 and the inner duct wall 17*a* provides an inner vertical cooling duct 18*a*, while similarly the annular space between the outer periphery of the disc coil and the outer duct wall 17*b* provides an outer vertical cooling duct 18*b*. The concentric or parallel vertical cooling ducts for the passage of coolant have approximately equal width in the radial direction, although equal width is not essential. Horizontal cooling ducts 19 of approximately the same height are defined between the horizontal major coil surfaces of adjacent individual disc coils 11*a*.

In accordance with the invention, a plurality of staggered, inner and outer partial flow barrier inserts or rings 20*a* and 20*b* are mounted on the disc winding 11 extending into the vertical cooling ducts 18*a* and 18*b* to improve the natural circulation of coolant through the cooling duct and the disc winding 11. The blockage provided by the flow barrier inserts 20*a* and 20*b* is small enough to prevent excessive natural circulation flow reduction and large enough to force a small fraction of the coolant flow through the horizontal cooling ducts 19, in a modified zig-zag type pattern for better cooling. The properly placed, partial cooling duct flow restrictions result in attaining a higher natural circulation cooled winding rating. The partial flow barrier inserts 20*a* and 20*b* are peripherally continuous (see FIG. 2) and are preferably attached to the vertical face or periphery of an individual disc coil 11*a*, normally having the same height as the disc coil. In terms of horizontal or radial width, the partial flow barrier inserts are sized to block about one-half to three-quarters of the width of the vertical cooling ducts 18*a* and 18*b*. The inserts 20*a* and 20*b* are mounted alternately in staggered fashion on the outside and inside of every several disc coils 11*a*. Preferably, they are regularly spaced in the axial direction, such as every fifth or eighth disc coil, but can be omitted in the cool parts of the winding toward the bottom to still further limit the total coolant flow reduction. Although normally attached to the disc winding 11, the partial flow barrier inserts 20*a* and 20*b* can, if desired, be attached to the cylindrical cooling duct walls 17 and 17*b*.

Figure 3:
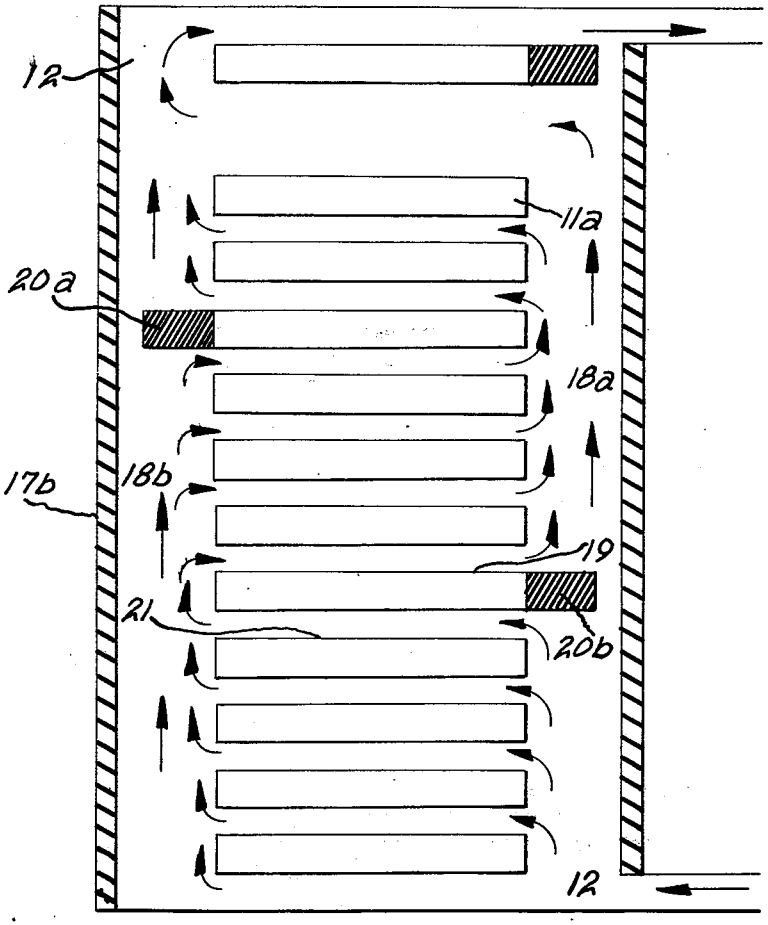
FIG. 3 is a schematic vertical cross section through half of the disc coil winding with arrows indicating the coolant flow paths.

The modified natural circulation flow patterns created by partially blocking the vertical cooling ducts 18*a* and 18*b* in a staggered manner is illustrated by the flow arrows in the FIG. 3 diagram. It will be appreciated that cooled liquid coolant 12 entering at the bottom of the disc winding 11 is heated by exposure to the hot winding, rising in temperature and changing density as the heated coolant rises in the cooling duct due to the thermal siphon effect. As was previously mentioned, in the absence of the partial flow barrier inserts 20*a* and 20*b*, most of the coolant flow is vertically in the vertical cooling ducts 18*a* and 18*b* and there is relatively little horizontal flow in the horizontal cooling ducts 19. That is, the flow pressure drop between the inner vertical cooling duct 18*a* and the outer vertical cooling duct 18*b* is minimized. By employing the staggered partial flow barrier inserts 20*a* and 20*b* in the vertical cooling ducts, the effect is to alternatively change the coolant flow pressure gradient in each duct by a predetermined amount. This predetermined gradient will alternatively force a small fraction of the vertical coolant flow from one side radially through to the other side of the disc coil. In each section of the disc coil between the partial flow barrier inserts 20*a* or 20*b*, coolant flow in the vertical cooling duct below the partial restriction is diverted horizontally between the individual disc coils 11*a* to the unrestricted vertical cooling duct. The modified zig-zag natural circulation flow pattern that is created is illustrated by the flow arrows and needs no further comment. By causing a small radial or horizontal flow, the horizontal major coil surfaces 21 are no longer covered by stagnant coolant layers as would be the case if there were no such partial flow barrier inserts. Only a small radial flow in the horizontal cooling ducts 19 will cause a significant improvement in disc coil cooling as the result of the improved heat transfer characteristics. The partial flow barrier inserts 20*a* and 20*b*, when properly dimensioned produce a sufficiently small vertical flow blockage that there is still a net gain in cooling performance.

The optimum amount of partial blockage, i.e., the horizontal dimension of the inserts 20*a* and 20*b*, can be determined by computer calculations. The factors involved are the radial dimensions of the coils, the disc coil separation in the vertical direction, and the frequency of blocking. It has already been pointed out that full blockage of the vertical cooling duct, as would be obtained by extending the rings 20*a* and 20*b* all the way to the duct wall is not desirable in a liquid-immersed natural circulation cooled transformer since the coolant flow rate is reduced substantially with a consequent excessive winding temperature rise. By using partial blockage of the vertical cooling ducts, rather than full blockage, the flow resistance in the total disc coil winding is reduced. Therefore, the flow rate is increased as compared to the full blockage case and excessive heating of the coolant and resulting excessive winding temperature rise does not occur. An analogy can be made to an electric circuit in which the amount of resistance is reduced so that the current flow is consequently increased.

The improvement in natural circulation of liquid coolant to enable higher transformer ratings is obtained at little expense with a relatively small modification of existing transformer designs. In the event that there is more than one disc coil winding surrounding a selected magnetic core, such as low voltage and high voltage windings, the partial flow barrier inserts 20*a* and 20*b* are used with each such winding and function in essentially the same manner. The partial flow barrier inserts or rings can be made of inexpensive insulating material, such as pressboard, are easily and inexpensively attached to the disc coils, and small variations in size due to manufacturing tolerances do not significantly change the amount of horizontal flow produced between the disc coils or flat coils. Accordingly, it is evident that the addition of partial flow barrier inserts to a wide variety of existing electrical transformers with disc or flat coil windings in an inexpensive and universal technique for improving the heat transfer from natural circulation cooled coils without excessively reducing the coolant flow rate.

While the invention has been particularly shown and described with reference to a preferred embodiment thereof, it will be understood by those skilled in the art that various changes in form and details may be made therein without departing from the spirit and scope of the invention.

What is claimed is:

1. An electrical transformer comprising a tank containing liquid insulating coolant in which is immersed at least one vertically oriented magnetic core element and associated surrounding flat coil transformer winding, said flat coil winding being comprised by a stack of equal sized flat coils vertically spaced from one another to define a plurality of horizontal cooling ducts therebetween, a pair of continuous duct walls respectively mounted inside and outside said flat coil winding to define inner and outer vertical cooling ducts of predetermined width in the horizontal direction for upward flow of said coolant by natural circulation, and a plurality of vertically spaced, peripherally continuous partial flow barrier inserts mounted in said inner and outer vertical cooling ducts in staggered relation without intervening barrier inserts at a uniform vertical spacing of several of said flat coils between each pair of staggered partial flow barrier inserts, each of said inserts extending only partially across its respective vertical cooling duct, and said inserts alternately partially blocking said vertical cooling ducts and forcing flow of said coolant through said horizontal cooling ducts.

2. A transformer according to claim 1 wherein said partial flow inserts are alternately attached to the inner and outer peripheries of selected flat coils separated vertically from one another by several of said coils.

3. A transformer according to claim 1 wherein said partial flow barrier inserts are alternately attached to the inner and outer peripheries of selected vertically separated flat coils and have a horizontal width of about half to three-quarters the width of the respective vertical cooling ducts.

4. An electrical transformer comprising a tank containing liquid insulating coolant in which is immersed at least one vertically mounted magnetic core element and associated surrounding disc coil transformer winding, said disc coil winding being comprised by a stack of equal sized disc coils vertically spaced from one another to define a plurality of horizontal cooling ducts therebetween, a pair of concentric cylindrical duct walls respectively mounted inside and outside said disc coil winding to define inner and outer vertical cooling ducts of approximately equal width in the horizontal direction for upward flow of said coolant by natural circulation, and a plurality of staggered partial flow barrier rings attached alternately to the inner and outer peripheries of selected disc coils without intervening barrier rings at a uniform vertical spacing of several said coils between each pair of staggered partial flow barrier rings, each of said rings extending only partially across its respective vertical cooling duct, and said rings thereby alternately partially blocking said vertical cooling ducts and forcing radial flow said coolant through said horizontal cooling ducts.

5. A transformer according to claim 4 wherein said partial flow barrier rings have a uniform horizontal width equal to about half to three-quarters the width of said vertical cooling ducts.

* * * * *